US005548269A

United States Patent [19]

Katsuno et al.

[11] Patent Number: 5,548,269

[45] Date of Patent: Aug. 20, 1996

[54] CHIP RESISTOR AND METHOD OF ADJUSTING RESISTANCE OF THE SAME

[75] Inventors: Takafumi Katsuno; Shigeru Kambara, both of Ukyo-ku, Japan

[73] Assignee: Rohm Co. Ltd., Kyoto, Japan

[21] Appl. No.: 313,922

[22] Filed: Sep. 26, 1994

[30] Foreign Application Priority Data

Nov. 17, 1993 [JP] Japan ..... 5-287995

[51] Int. Cl.[6] ..... H01C 1/12; H01C 1/148

[52] U.S. Cl. ..... 338/325; 338/195; 338/308; 338/332

[58] Field of Search ..... 338/325, 332, 338/195–308

[56] References Cited

U.S. PATENT DOCUMENTS

| | | | |
|---|---|---|---|
| 3,772,631 | 11/1973 | Owen | 338/195 |
| 4,032,881 | 6/1977 | Singleton | 338/195 |
| 4,294,648 | 10/1981 | Brede et al. | 338/308 X |
| 4,418,474 | 12/1983 | Barnett | 338/195 X |
| 4,904,850 | 2/1990 | Claypool et al. | 219/548 |
| 5,015,989 | 5/1991 | Wohlfarth et al. | 338/195 |
| 5,051,719 | 9/1991 | Gaston et al. | 338/162 |
| 5,065,221 | 11/1991 | Imamura | 257/538 |
| 5,198,794 | 3/1993 | Sato et al. | 338/195 |
| 5,212,466 | 5/1993 | Yamada et al. | 338/22 R |
| 5,285,184 | 2/1994 | Hatta et al. | 338/313 |

FOREIGN PATENT DOCUMENTS

| | | | |
|---|---|---|---|
| 24134572 | 9/1975 | Germany | H01C 7/00 |
| 2834207 | 2/1980 | Germany | H01C 13/00 |
| 2904197 | 8/1980 | Germany | H01C 1/014 |
| 3616217 | 4/1987 | Germany | H01C 17/24 |
| 3811854 | 10/1989 | Germany | G01R 31/28 |
| 94030278 | 6/1994 | Germany | H01C 7/00 |

OTHER PUBLICATIONS

Delfs, H.: Hybridschaltungen, Abgleichverfahren für Widerstände. In: Internationale Elektronische Rundschau 1971, Nr. 8, S. 195–199.

AEG Hilfsbuch Für elektronische Licht–und Kraftanlagen der allgemeinen Elektricitäts–Gesellschaft, 7. Aufl., S. 300–303; 1956.

JP 4–139701 A., In: Patents Abstracts of Japan, E–1257, Sep., 2, 1992, vol. 16, No. 415.

*Primary Examiner*—Teresa J. Walberg
*Assistant Examiner*—Raphael Valencia
*Attorney, Agent, or Firm*—Michael D. Bednarek

[57] ABSTRACT

A chip resistor is provided which comprises an insulating chip substrate, a resistor element formed on the chip substrate, a first pair of electrode terminals branching out from one end of the resistor element, and a second pair of electrode terminals branching out from the other end of the resistor element. One of the first pair electrode terminals is a current terminal while the other of the first pair electrode terminals is a voltage terminal. Similarly, one of the second pair electrode terminals is a current terminal, and the other of the second pair electrode terminals is a voltage terminal.

9 Claims, 11 Drawing Sheets

CHIP RESISTOR AND METHOD OF ADJUSTING RESISTANCE OF THE SAME

BACKGROUND OF THE INVENTION

1. Field of the Invention

This invention relates to a chip resistor which can be suitably used for detecting a small current. The present invention also relates to a current detecting circuit and method utilizing such a chip resistor. The present invention further relates to a method of adjusting the resistance of such a resistor.

2. Description of the Related Art

As is well known, chip resistors are used in various applications and have proven to enable high integration (high-density mounting). For the convenience of description, reference is now made to FIGS. 17 through 20 showing three different prior art chip resistors.

As shown in FIGS. 17 and 18, a typical prior art chip resistor comprises an insulating chip substrate a on which a resistor element b is formed by printing a resistor material paste. The resistor element b is connected endwise to a pair of electrode terminals c formed by printing a conductive paste. Further, the resistor element b is covered by a glass coating d for protection.

FIG. 19 shows another prior art chip resistor which differs from the resistor of FIGS. 17 and 18 only in that it comprises a shorter resistor element b. Such a chip resistor is advantageously usable as a current detector in a protection circuit for a DC/DC converter for example because it is capable of providing a low resistance of say 0.1Ω .

FIG. 20 shows a further prior art chip resistor wherein a very narrow resistor element b is formed of a conductive paste integrally with electrode terminals c by simultaneous printing. Apparently, the resistor element b made of a conductive paste is suitable for providing a very low resistance.

According to either one of the prior art arrangements, the resistance of the chip resistor is determined for resistance adjustment by the so-called "four terminal method" as shown in FIG. 21. In FIG. 21, reference sign R1 represents the resistance of the resistor element b, whereas reference signs R2, R3 indicate the respective resistances of the two electrode terminals b.

As shown into FIG. 21, voltage detecting probes p are brought into contact with the respective electrode terminals c. In this condition, a current of a known value is allowed to flow across the electrode terminals c, and the voltage drop across the voltage detecting probes p is measured.

According to the method described above, since the two electrode terminals c are used for supplying the current and for detecting the voltage drop, it is impossible to determine the resistance of the resistor element b alone. Indeed, the measured voltage drop only represents the sum of the resistances R1, R2, R3. Further, since the resistances R2, R3 (which are very small) of the electrode terminals c are influenced not only by the conditions of thick film printing but also by solder deposits used for mounting the chip resistor, it is extremely difficult to equalize the resistance characteristics from one chip resistor to another.

The above-describe problem is particularly remarkable when the chip resistor is intended for providing a very low resistance because the small resistances R2, R3 of the electrode terminals c become more significant in determining the overall resistance of the chip resistor. Further, difficulty is also encountered when using the chip resistor as a detector for accurately measuring a small current.

SUMMARY OF THE INVENTION

It is, therefore, an object of the present invention to provide a chip resistor whose resistance can be accurately adjusted and which can be suitably used for detecting a small current.

The present invention also seeks to provide a current detecting circuit incorporating such a chip resistor.

The present invention further seeks to provide a method of detecting a current by using such a chip resistor.

Moreover, the present invention additionally aims to provide a method of adjusting the resistance of such a resistor.

According to one aspect of the present invention, there is provided a chip resistor comprising: an insulating chip substrate; a resistor element formed on the chip substrate; a first pair of electrode terminals branching out from one end of the resistor element, one of the first pair electrode terminals being a current terminal, the other of the first pair electrode terminals being a voltage terminal; and a second pair of electrode terminals branching out from the other end of the resistor element, one of the second pair electrode terminals being a current terminal, the other of the second pair electrode terminals being a voltage terminal.

According to a preferred embodiment of the present invention, the electrode terminals of the first and second pairs are located respectively at the four corners of a rectangle. In such an embodiment, the current terminal of the first pair is located diagonally opposite to the current terminal of the second pair, whereas the voltage terminal of the first pair being located diagonally opposite to the voltage terminal of the second pair.

Preferably, the resistor element may extend generally diagonally of the rectangle from the current terminal of the first pair toward the current terminal of the second pair. Such an inclination of the resistor element eliminates sharp bends of the current path, thereby reducing thermal damage at the bends.

The electrode terminals of the first pair may be located at a first side of the rectangle, whereas the electrode terminals of the second pair may be located at a second side of the rectangle which is opposite to the first side. Alternatively, the current terminal of the first pair and the voltage terminal of the second pair may be located at a first side of the rectangle, whereas the voltage terminal of the first pair and the current terminal of the second pair may be located at a second side of the rectangle which is opposite to the first side.

It is also advantageous that the chip resistor further comprise at least one additional resistor element formed on the chip substrate; a third pair of electrode terminals branch out from one end of said additional resistor element; and a fourth pair of electrode terminals branch out from the other end of said additional resistor element.

According to another aspect of the present invention, there is provided a current detecting circuit incorporating a chip resistor which comprises: an insulating chip substrate; a resistor element formed on the chip substrate; a first pair of electrode terminals branch out from one end of the resistor element, one of the first pair electrode terminals being a current terminal, the other of the first pair electrode terminals being a voltage terminal; and a second pair of electrode terminals branch out from the other end of the resistor element, one of the second pair electrode terminals being a current terminal, the other of the second pair electrode terminals being a voltage terminal; wherein the current terminals of the first and second pair are electrically connected to a current supplying source; and the voltage terminals of the first and second pair are electrically connected to a voltage detector.

According to a further aspect of the present invention, there is provided a current detecting method performed by using a chip resistor which comprises: an insulating chip substrate; a resistor element formed on the chip substrate; a first pair of electrode terminals branch out from one end of the resistor element, one of the first pair electrode terminals being a current terminal, the other of the first pair electrode terminals being a voltage terminal; and a second pair of electrode terminals branch out from the other end of the resistor element, one of the second pair electrode terminals being a current terminal, the other of the second pair electrode terminals being a voltage terminal; wherein the method comprises the steps of: supplying a current across the current terminals of the first and second pairs; and measuring a voltage drop across the voltage terminals of the first and second pairs.

According to still another aspect of the present invention, there is provided a method of adjusting a resistance of a chip resistor which comprises: an insulating chip substrate; a resistor element formed on the chip substrate; a first pair of electrode terminals branch out from one end of the resistor element, one of the first pair electrode terminals being a current terminal, the other of the first pair electrode terminals being a voltage terminal; and a second pair of electrode terminals branch out from the other end of the resistor element, one of the second pair electrode terminals being a current terminal, the other of the second pair electrode terminals being a voltage terminal; wherein the method comprises the steps of: supplying a known current across the current terminals of the first and second pairs;

measuring a voltage drop across the voltage terminals of the first and second pairs; and trimming at least one end of the resistor element until the measured voltage drop reaches a predetermined value.

Other objects, features and advantages of the present invention will be fully understood from the following detailed description given with reference to the accompanying drawings.

DETAILED DESCRIPTION OF THE PREFERRED EMBODIMENTS

Throughout the accompanying drawings, like parts are designated by the same reference signs for clarifying the relation between different embodiments of the present invention.

Figure 1:
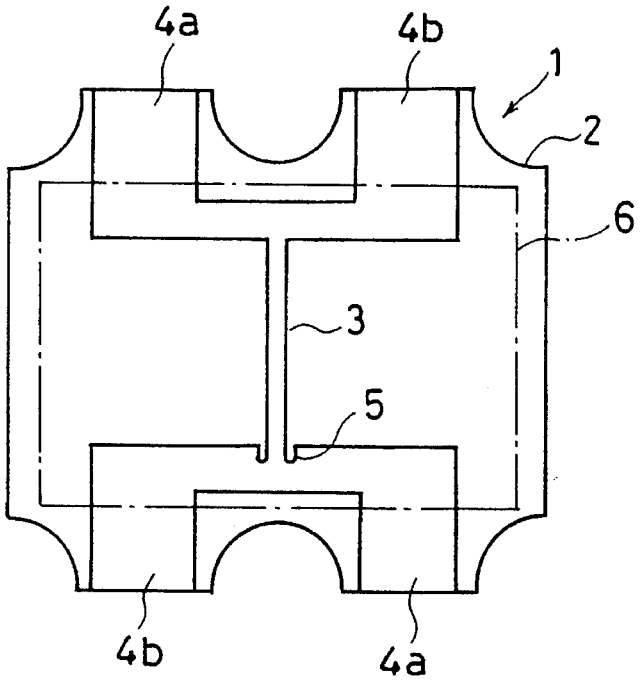
FIG. 1 is a plan view showing a chip resistor according to a first embodiment of the present invention.
Figure 2:
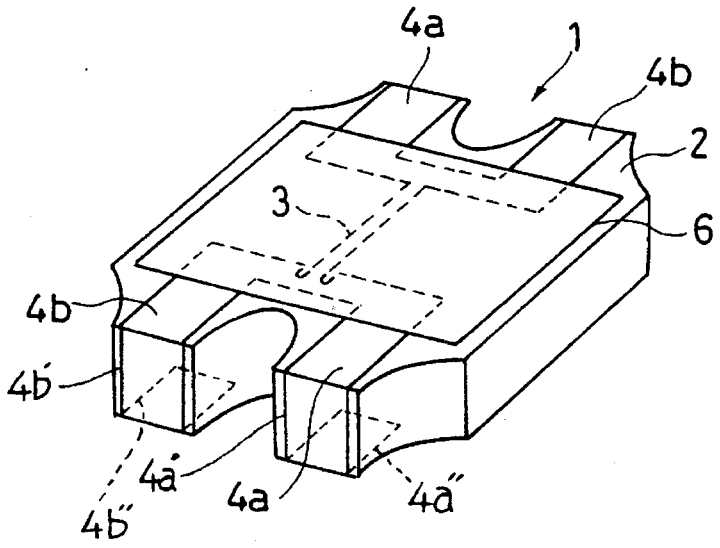
FIG. 2 is a perspective view showing the same resistor.

Referring first to FIGS. 1 and 2, there is shown a chip resistor according to a first embodiment of the present invention. The chip resistor, represented by reference numeral 1, comprises an insulating chip substrate 1 made of a ceramic material such as alumina. In the illustrated embodiment, the chip substrate 1 is generally rectangular or square, but it may be otherwise shaped.

The chip substrate 1 has an upper surface formed with a resistor element 3. A pair of electrode terminals 4*a*, 4*b* branch out from one end of the resistor element 3 toward one side of the chip substrate 2. A similar pair of electrode terminals 4*a*, 4*b* branch out from the other end of the resistor element 3 toward the opposite side of the chip substrate 2. Of the four electrode terminals, two terminals represented by reference sign 4*a* are used as current terminals, whereas the other two terminals 4*b* are used as voltage terminals.

According to the first embodiment, the four electrode terminals 4*a*, 4*b* are located at the respective corners of a rectangle. The two current terminals 4*a* are positioned diagonally opposite to each other, as also are the two voltage terminals 4*b*. Such an arrangement is preferred because the chip resistor 1 may be symmetrically mounted to a circuit board to assume 180° opposite orientations, thereby facilitating handling of the chip resistor 1 for surface mounting.

The resistor element 3 and the respective electrode terminals 4*a*, 4*b* may be integrally formed of a conductive paste such as silver-palladium paste or silver paste deposited by thick film printing. Even if a conductive paste is used, the resistor element 3 may be made to have a low resistance of 0.01–1.00Ω by greatly decreasing its width and by selecting a suitable length for it.

As shown in FIG. 2, each of the electrode teminals 4*a*, 4*b* has a side extension 4*a*', 4*b*' and a rear extension 4*a*", 4*b*". The rear extension 4*a*", 4*b*" comes into electrical contact with a corresponding electrode pad (not shown) of a circuit board upon surface mounting of the chip resistor 1.

For adjusting the resistance of the resistor element 3, trimmed portions 5 formed by partial removal of the conductive paste may be provided at least at one end of the resistor element 3. Apparently, the trimmed portions 5 increase the effective length of the resistor element B to change its resistance.

The upper surface of the chip substrate 2 is covered by a protective coating 6 in a manner such that the four electrode terminals 4*a*, 4*b* remain exposed. The protective coating 6 may be made of glass for example.

In manufacture, use is made of a master ceramic plate (not shown), as usually practiced for making conventional chip resistors. The master plate is formed with a plurality of longitudinal and transverse cutting lines (scribed lines for example) later used for division into a plurality of unit chip substrates 2. Thick film printing is first performed for simultaneously forming resistor elements 3 and electrode terminals 4*a*, 4*b* (see FIGS. 1 and 2) with respect to all of the sections corresponding to the unit chip substrates 2. Then, the master plate is divided into the unit chip substrates by cutting along the cutting lines. After division of the master plate, side extensions 4*a*', 4*b*' and rear extensions 4*a*", 4*b*" are formed for the respective unit chip substrates 2 in a conventional manner.

The electrical resistance of the resistor element 3 of each chip resistor 1 thus obtained is determined and adjusted by the so-called "four terminal method", as described below.

Figure 3:
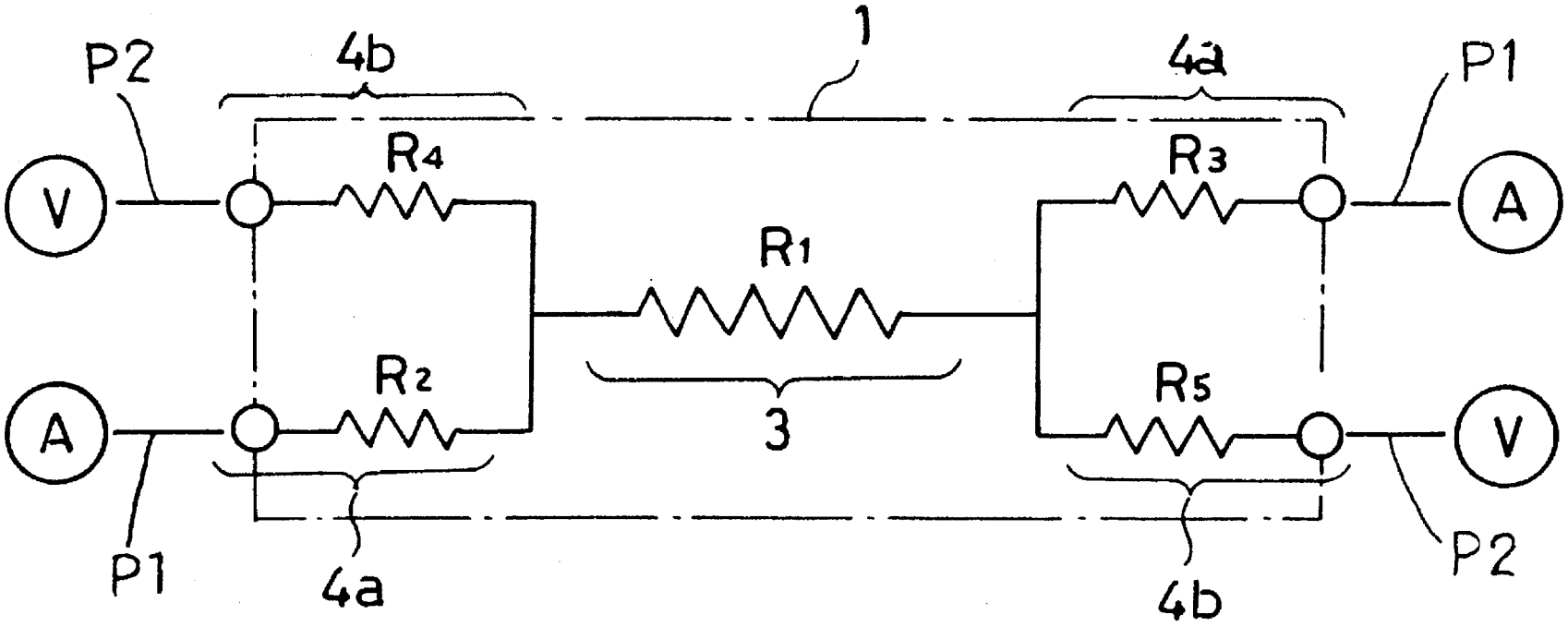
FIG. 3 is a circuit diagram showing how the resistance of the same resistor is determined and adjusted.

FIG. 3 shows an equivalent circuit for resistance measurement. The resistance of the resistor element 3 is represented by reference sign R1. Further, the respective internal resistances of the current terminals 4*a* are represented by reference signs R2, R3, whereas the respective internal resistances of the voltage terminals 4*a* are represented by reference signs R4, R5.

As shown in FIG. 3, for resistance determination and adjustment, current probes P1 are brought into contact with the respective current terminals 4*a*, whereas voltage detecting probes P2 are brought into contact with the respective voltage terminals 4*b*. In this condition, a current of a known value is allowed to flow between the current terminals 4*a*, and the voltage drop across the voltage detecting probes P2 is measured. Laser trimming 5 (see FIG. 1) may be performed until the measured voltage drop reaches a predetermined target value which corresponds to the desired resistance for the resistor element 3.

Figure 21:
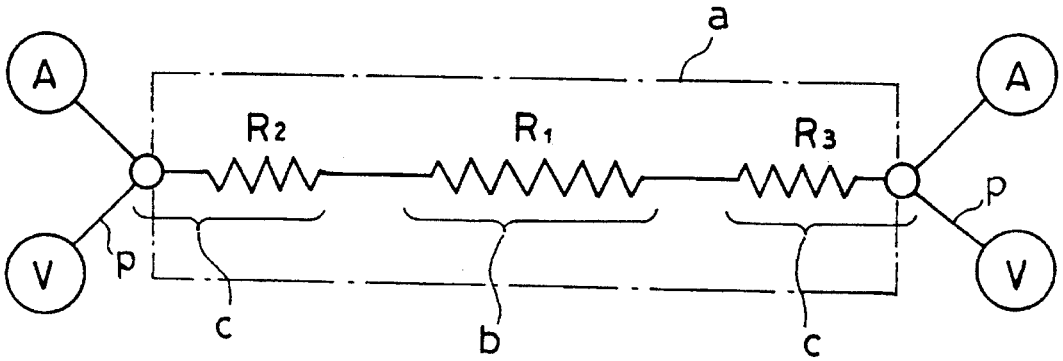
FIG. 21 Prior Art
FIG. 21 is a circuit diagram showing how to use the prior art resistor for current detection.

According to the method described above, little current flows through the respective voltage terminals 4*b* because these terminals are provided separately from the current terminals 4*b* through which most of the current flows. Thus, the voltage drop across the voltage detecting probes P2 substantially corresponds to the voltage drop across the resistor element 3. As a result, it is possible to accurately measure and adjust the resistance R1 of the resistor element 3 despite the inherent internal resistances of the current terminals 4*a*. Apparently, this is a remarkable improvement over the prior art (see FIG. 21) wherein the sum of the resistances R1, R2, R3 is inevitably measured.

In this way, the resistance R1 of the resistor element 3 can be accurately measured and adjusted. Therefore, it is possible to equalize the resistance characteristics from one chip resistor to another, thereby increasing the production yield.

The chip resistor 1 may be used as a current sensor in a current detecting circuit for example. Such an application is now described with reference to FIG. 4.

Figure 4:
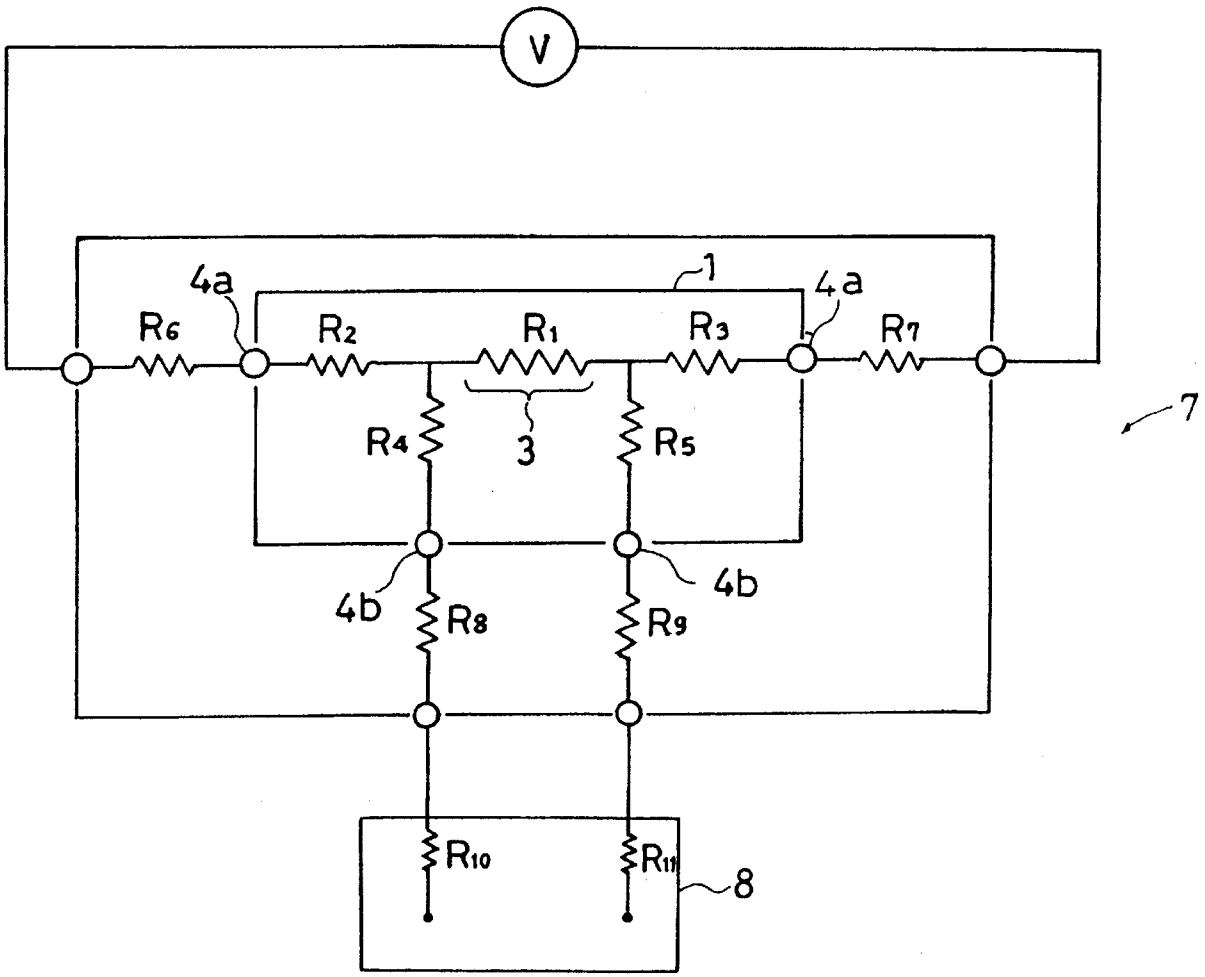
FIG. 4 is a circuit diagram showing how to use the same resistor for detecting a current.

In FIG. 2, the chip resistor 1 is shown to be incorporated in a current detecting circuit 7. When the current detecting circuit 7 is used for current detection in a DC/DC converter for example, the current terminals 4*a* are connected to a current supplying source, whereas the voltage terminals 4*b* are connected to a voltage detector 8. Reference signs R6–R9 in FIG. 4 represent internal resistances present in the current detecting circuit 7. Reference signs R10, R11 represent internal resistances present in the voltage detector 8.

With the circuit arrangement described above, the resistance R1 of the resistor element 3 is accurately known (determined). Therefore, by measuring the voltage drop across the resistor element 3 (R1), it is possible to accurately determine the current through the resistor element B according to the Ohm's law. At this time, little current flows in a path containing the voltage detector 8, so that the internal resistances R4, R5 of the voltage terminals 4*b* give only negligible influence on the voltage drop measurement.

In this way, since the voltage terminals 4*b* are provided separately from the current terminals 4*a*, it is possible to exclude the adverse influences which might be caused by the internal resistances R2, R3 of the current terminals 4 in determining the current through the resistor element 3.

In addition to the advantages described above, the chip resistor 1 is also advantageous in that it can be conveniently mounted on the surface of the circuit board and enables high integration together with other circuit elements on the same circuit board.

Figure 5:
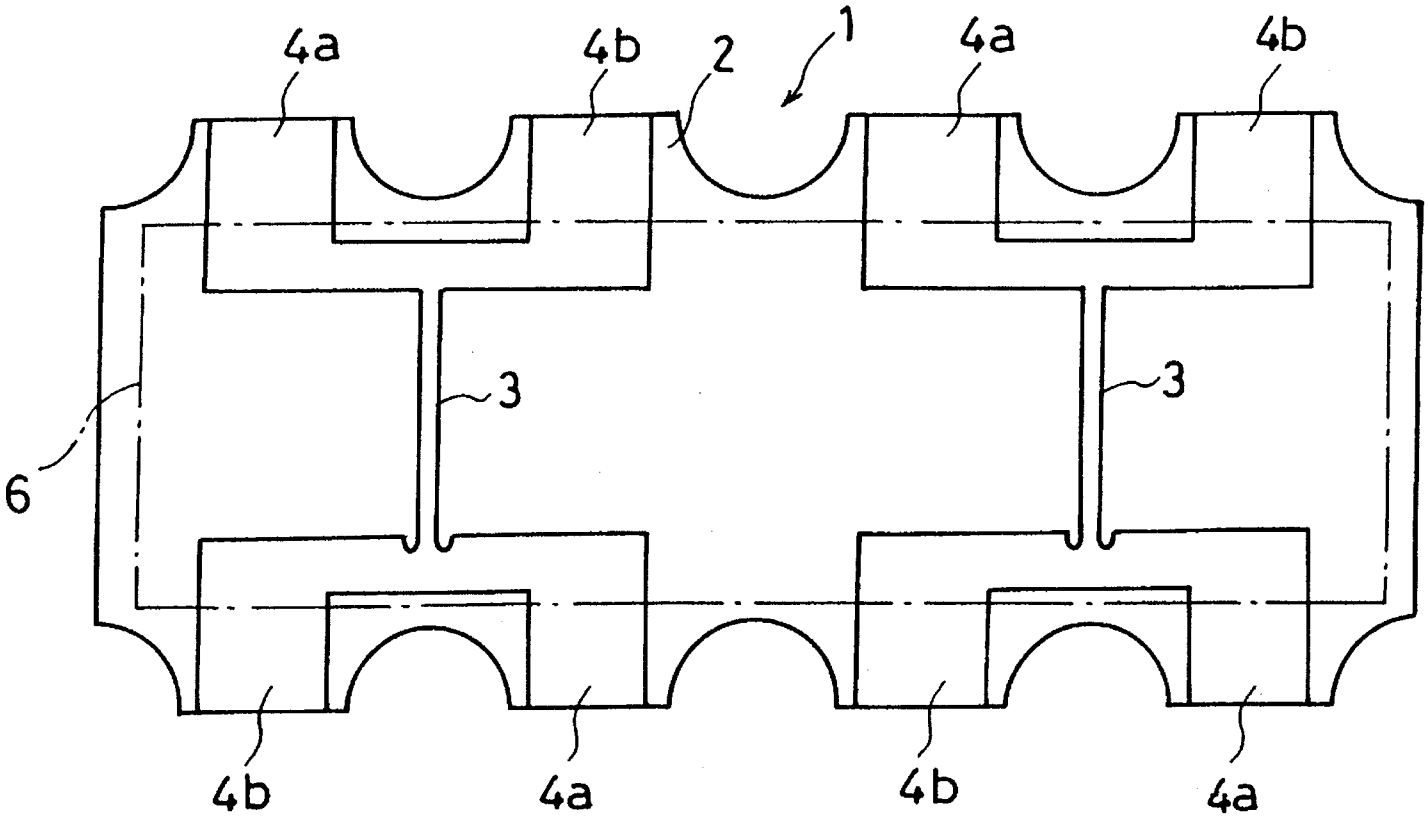
FIG. 5 is a plan view showing a chip resistor according to a second embodiment of the present invention.

FIG. 5 shows a chip resistor 1 according to a second embodiment of the present invention. The chip resistor 1 of this embodiment comprises an elongated chip substrate 2 for carrying two resistor elements 3 in parallel to each other. Each of the resistor elements 3 is equally associated with a set of four electrode terminals 4*a*, 4*b* and covered by a common protective glass coating 6. The chip resistor 1 of the second embodiment is otherwise the same as that of the first embodiment.

Figure 6:
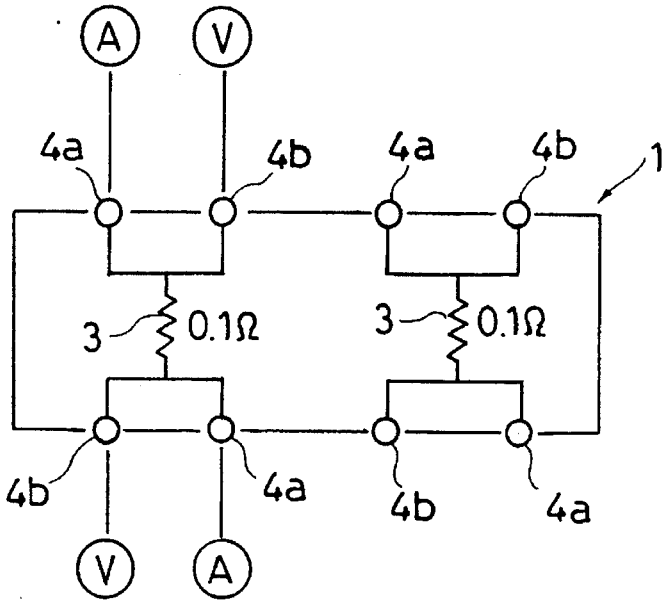
FIG. 6 is a circuit diagram showing one use of the chip resistor illustrated in FIG. 5.
Figure 7:
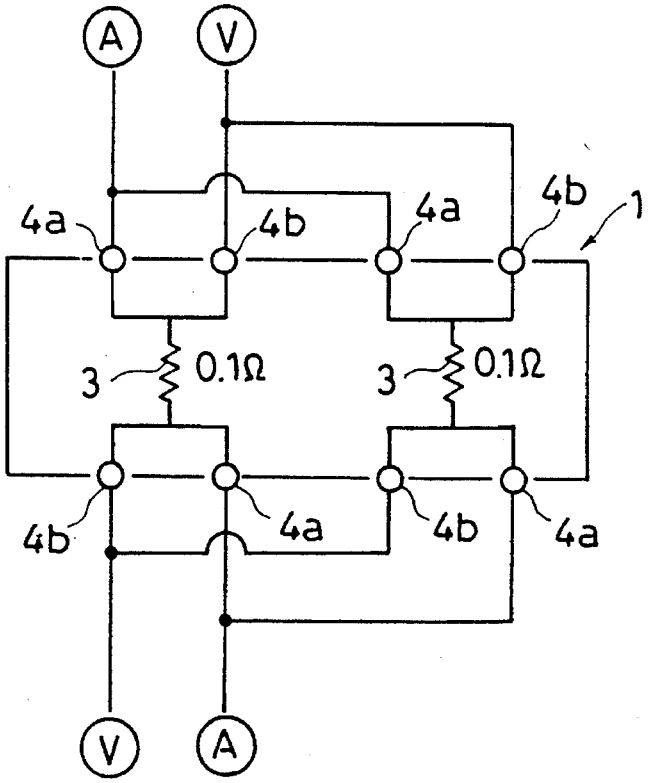
FIG. 7 is a circuit diagram showing another use of the chip resistor illustrated in FIG. 5.

The chip resistor 1 of the second embodiment may be used in different ways. Assuming now that each of the resistor elements 3 has a resistance of 0.1Ω for example, the chip resistor 1 as a whole may be used to provide a resistance of 0.1Ω by using only one of the resistor elements 3, as shown in FIG. 6. On the other hand, the chip resistor 1 can also provide a resistance of 0.5Ω by connecting the two resistor elements 3 in parallel to each other, as shown in FIG. 7. Apparently, a resistance of 0.2Ω is also obtainable by connecting the two resistor elements 3 in series (not shown).

Figure 8:
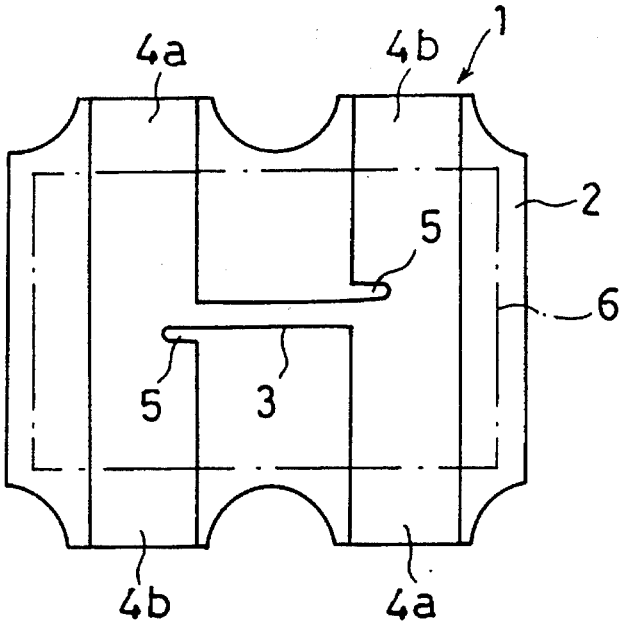
FIG. 8 is a plan view showing a chip resistor according to a third embodiment of the present invention.

FIG. 8 shows a chip resistor 1 according to a third embodiment of the present invention. The chip resistor 1 of this embodiment is similar to that of the first embodiment (FIG. 1) but differs therefrom only in the following points.

First, two electrode terminals 4*a*, 4*b* branching out from each end of a chip element 3 extend toward two opposite sides of the chip substrate 2, as opposed to the first embodiment (see FIG. 1) wherein the two electrode terminals 4*a*, 4*b* branching out from each end of the resistor element 3 extend to a common side of the chip substrate 1. Secondly, the resistance of the chip element 3 is adjusted by two trimmed portions 5 which are respectively formed at the opposite ends of the resistor element 3 by laser trimming.

Figure 9:
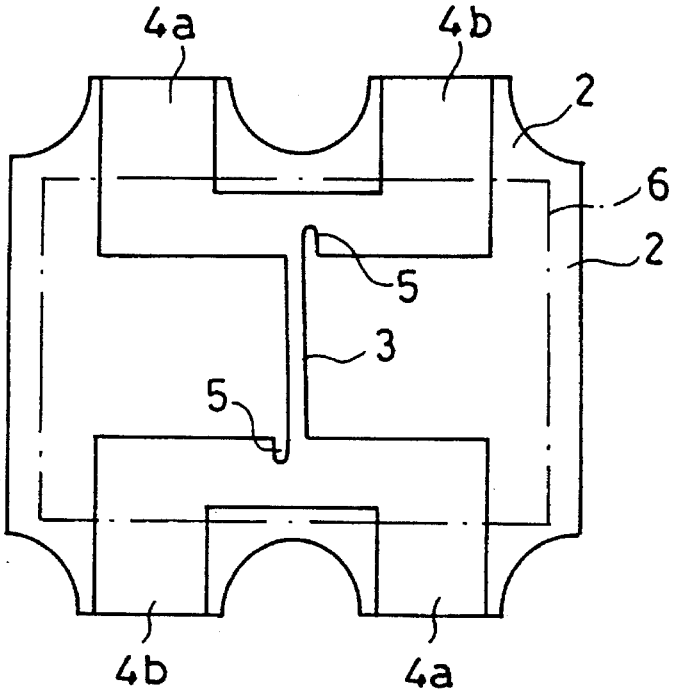
FIG. 9 is a plan view showing a chip resistor according to a fourth embodiment of the present invention.

FIG. 9 shows a chip resistor 1 according to a fourth embodiment of the present invention. The chip resistor 1 of this embodiment is similar to that of the first embodiment (see FIG. 1) but differs therefrom only in that the resistance of the chip element 3 is adjusted by two trimmed portions 5 which are respectively formed at the opposite ends of the resistor element 3 by laser trimming.

Figure 10:
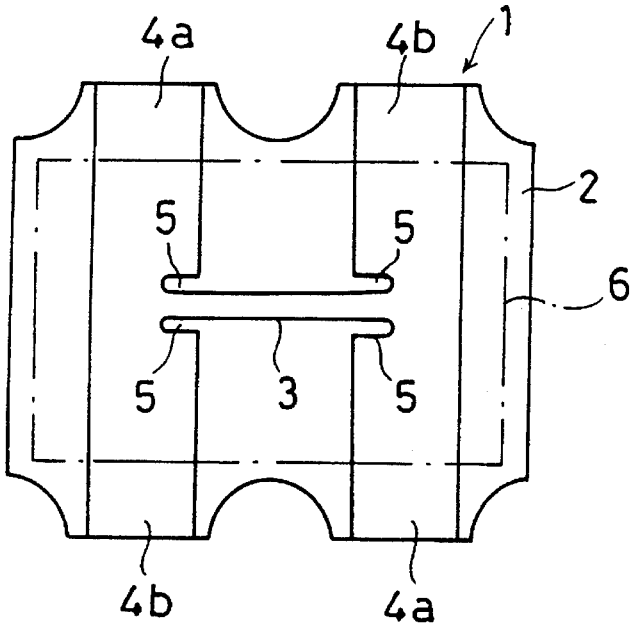
FIG. 10 is a plan view showing a chip resistor according to a fifth embodiment of the present invention.

FIG. 10 shows a chip resistor 1 according to a fifth embodiment of the present invention. The chip resistor 1 of this embodiment is similar to that of the third embodiment (see FIG. 8) but differs therefrom only in that two trimmed portions 5 are formed at each end of the resistor element 3 for providing a total of four trimmed portions.

Figure 11:
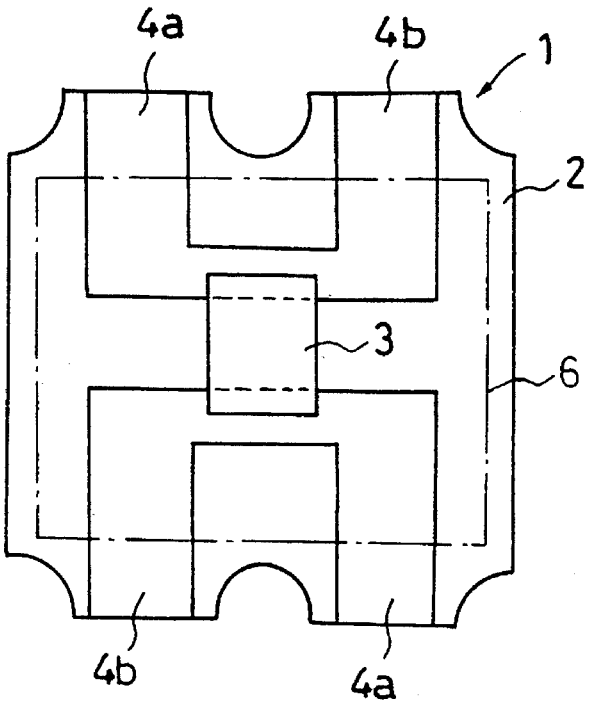
FIG. 11 is a plan view showing a chip resistor according to a sixth embodiment of the present invention.

FIG. 11 shows a chip resistor 1 according to a sixth embodiment of the present invention. The chip resistor 1 of this embodiment is similar to that of the first embodiment (see FIG. 1) but differs therefrom only in that a resistor element 3 is formed separately from the respective electrode terminals 4*a*, 4*b*. The resistor element 3 may be made of a resistor material paste such as ruthenium oxide paste. Though not illustrated in FIG. 11, the resistance of the resistor element 5 may be adjusted by laser trimming.

Apparently, the use of the resistor material paste widens the range of resistance obtainable by the resistor element 3. Further, the resistor element 3 may be made to have a relatively large width.

Figure 12:
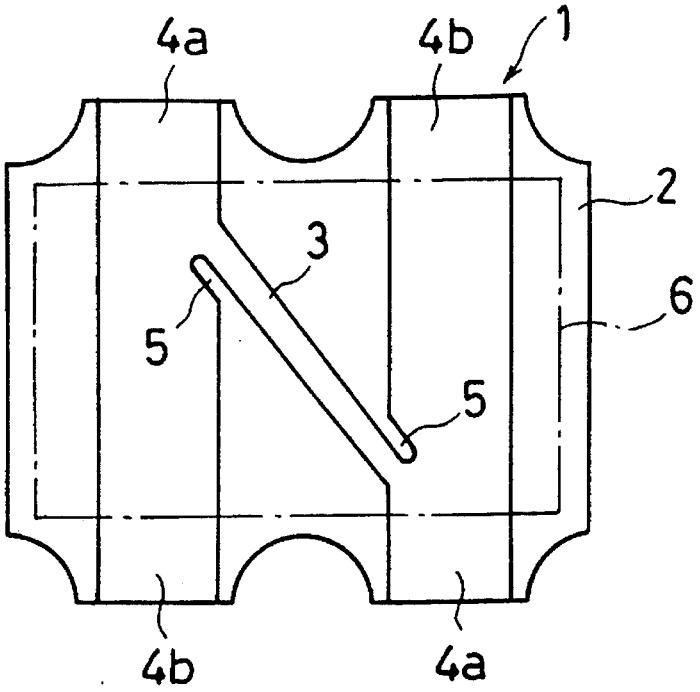
FIG. 12 is a plan view showing a chip resistor according to a seventh embodiment of the present invention.
Figure 13:
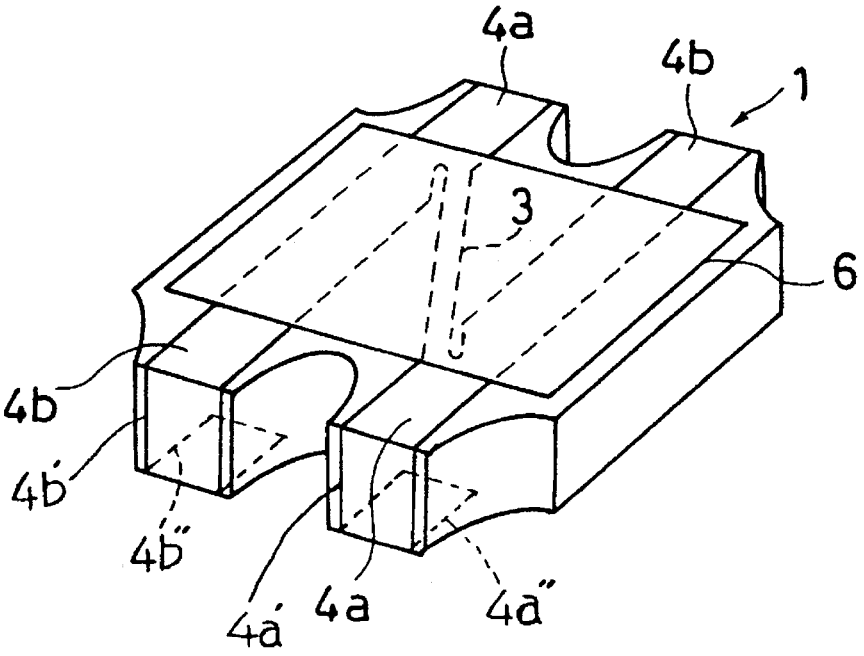
FIG. 13 is a perspective view showing the chip resistor of FIG. 12.
Figure 14:
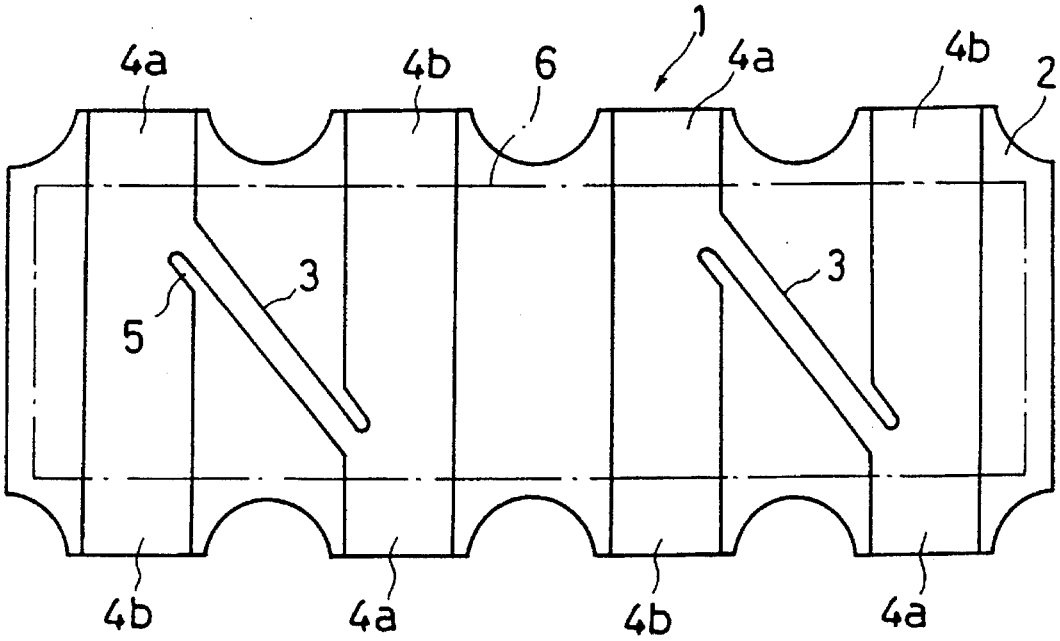
FIG. 14 is a plan view showing a chip resistor according to an eighth embodiment of the present invention.

FIGS. 12 and 13 show a chip resistor 1 according to a seventh embodiment of the present invention. The chip resistor 1 of this embodiment is similar to that of the third embodiment (see FIG. 8) but differs therefrom only in that a resistor element 3 is formed generally diagonally of the chip substrate 2 from one current electrode terminal 4*a* to the other.

According to the seventh embodiment, the resistor element 3 extends diagonally or obliquely to minimize the degree of bends in the current path. Thus, it is possible to reduce local thermal damage which might be caused by current concentration at the bends of the current path, thereby prolonging the service life of the chip resistor 1 while increasing the operating reliability of the chip resistor.

FIG. 12 shows a chip resistor 1 according to an eighth embodiment of the present invention which is similar to the second embodiment (see FIG. 5). Specifically, the chip resistor 1 of the eighth embodiment comprises an elongated chip substrate 2 for carrying two resistor elements 3 which are obliquely formed but arranged in parallel to each other. Each of the resistor elements 3 is equally associated with a set of four electrode terminals 4*a*, 4*b* and covered by a common protective glass coating 6.

Like the second embodiment, the chip resistor 1 of the eighth embodiment may be used in different ways. Either one of the resistor elements 3 may be used (see FIG. 6) for utilizing a full resistance of that resistor element. Alternatively, the two resistor elements B may be connected in parallel for halving the resistance (see in FIG. 7), or in series for doubling the resistance.

Figure 15:
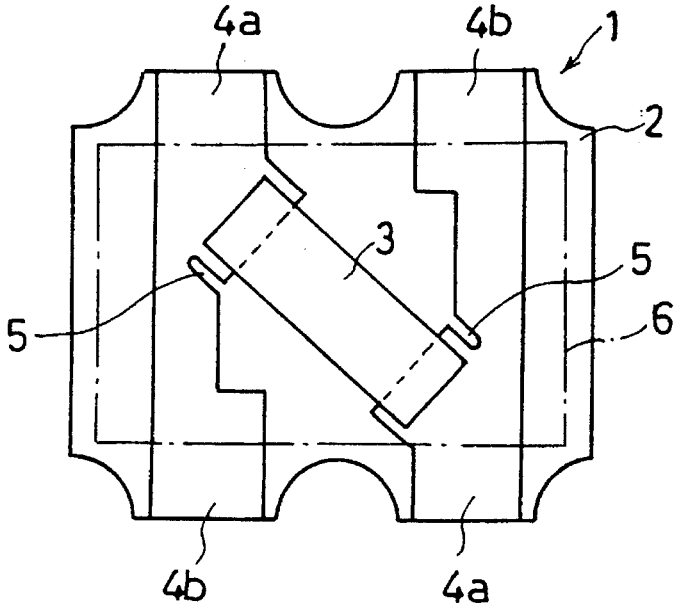
FIG. 15 is a plan view showing a chip resistor according to a ninth embodiment of the present invention.

FIG. 15 shows a chip resistor 1 according to a ninth embodiment of the present invention. The chip resistor 1 of this embodiment is similar to that of the seventh embodiment (see FIG. 12) but differs therefrom only in that a resistor element B is formed separately from the respective electrode terminals 4*a*, 4*b* by using a resistor material paste such as ruthenium oxide paste.

Figure 16:
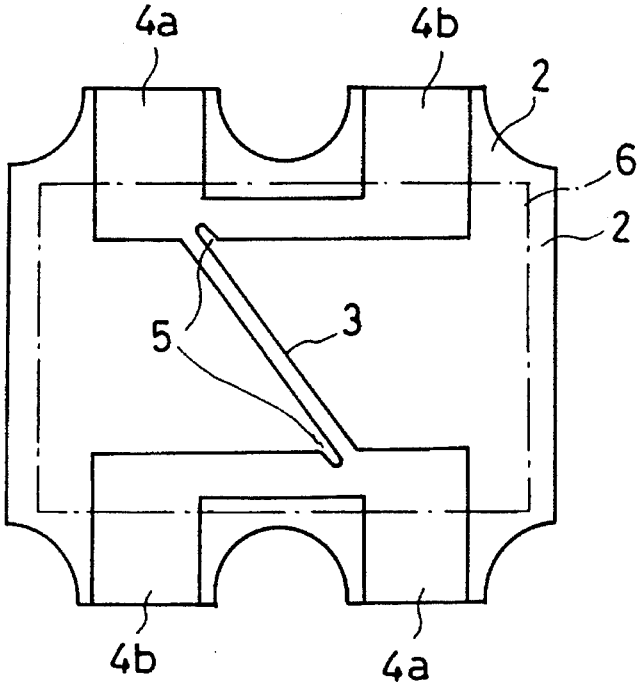
FIG. 16 is a plan view showing a chip resistor according to a tenth embodiment of the present invention.
Figure 17:
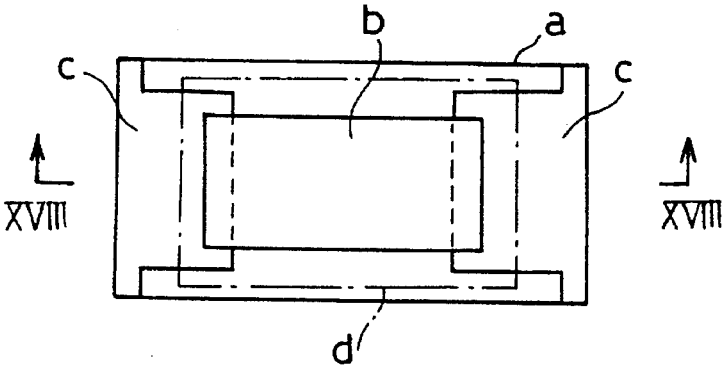
FIG. 17 Prior Art
FIG. 17 is a plan view showing a prior art chip resistor.
Figure 18:
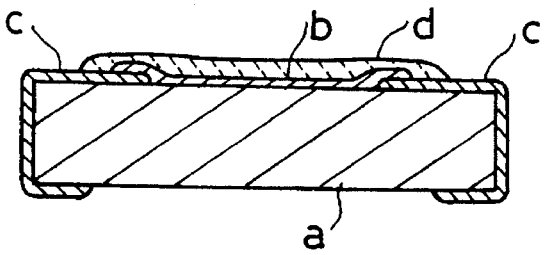
FIG. 18 Prior Art
FIG. 18 is a sectional view taken along lines XVIII—XVIII in FIG. 17.
Figure 19:
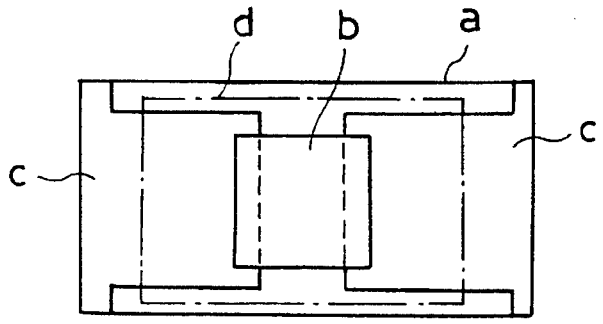
FIG. 19 Prior Art
FIG. 19 is a plan view showing another prior art chip resistor.
Figure 20:
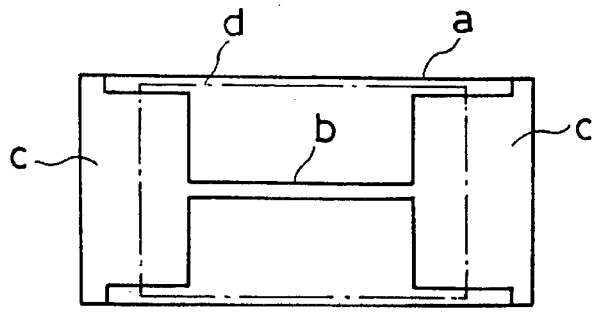
FIG. 20 Prior Art
FIG. 20 is a plan view showing still another prior art chip resistor.

FIG. 16 shows a chip resistor 1 according to a tenth embodiment of the present invention. The chip resistor 1 of this embodiment is similar to that of the seventh embodiment (see FIG. 12) but differs therefrom only in that two electrode terminals 4*a*, 4*b* branching out from each end of an oblique chip element 3 extend toward a common side of the chip substrate 2, as opposed to the seventh embodiment (see FIG. 12) wherein two electrode terminals 4*a*, 4*b* branching out from each end of the resistor element 3 extend to two opposide sides of the chip substrate 1.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

We claim:

1. A chip resistor comprising:

an insulating chip substrate;

a resistor element formed on the chip substrate;

a first pair of electrode terminals branching out from one end of the resistor element, one of the first pair of electrode terminals being a current terminal, the other of the first pair of electrode terminals being a voltage terminal; and a second pair of electrode terminals branching out from the other end of the resistor element, one of the second pair of electrode terminals being a current terminal, the other of the second pair of electrode terminals being a voltage terminal;

wherein at least one of the electrode terminals of the first and second pairs is formed with a trimmed portion extending along the resistor element at least at one end thereof.

2. The chip resistor according to claim 1, further comprising:

at least one additional resistor element formed on the chip substrate;

a third pair of electrode terminals branch out from one end of said additional resistor element; and a fourth pair of electrode terminals branch out from the other end of said additional resistor element.

3. The chip resistor according to claim 1, wherein the electrode terminals of the first and second pairs are located respectively at the four corners of a rectangle, the current terminal of the first pair being located diagonally opposite to the current terminal of the second pair, the voltage terminal of the first pair being located diagonally opposite to the voltage terminal of the second pair.

4. The chip resistor according to claim 3, wherein the resistor element extends generally diagonally of said rectangle from the current terminal of the first pair toward the current terminal of the second pair.

5. The chip resistor according to claim 2, wherein the electrode terminals of the first pair are located at a first side of said rectangle, whereas the electrode terminals of the second pair are located at a second side of said rectangle which is opposite to said first side.

6. The chip resistor according to claim 3, wherein the current terminal of the first pair and the voltage terminal of the second pair are located at a first side of said rectangle, whereas the voltage terminal of the first pair and the current terminal of the second pair are located at a second side of said rectangle which is opposite to said first side.

7. A current detecting circuit incorporating a chip resistor which comprises: an insulating chip substrate; a resistor element formed on the chip substrate; a first pair of electrode terminals branching out from one end of the resistor element, one of the first pair of electrode terminals being a current terminal, the other of the first pair of electrode terminals being a voltage terminal; and a second pair of electrode terminals branching out form the other end of the resistor element, one of the second pair of electrode terminals being a current terminal, the other of the second pair of electrode terminals being a voltage terminal; at least one of the electrode terminals of the first and second pairs being formed with a trimmed portion extending along the resistor element at least at one end thereof; wherein the current terminals of the first and second pairs are electrically connected to a current supplying source; and the voltage terminals of the first and second pairs are electrically connected to a voltage detector.

8. A current detecting method performed by using a chip resistor which comprises: an insulating chip substrate; a resistor element formed on the chip substrate; a first pair of electrode terminals branching out from one end of the resistor element, one of the first pair of electrode terminals being a current terminal, the other of the first pair of electrode terminals being a voltage terminal; and a second pair of electrode terminals branching out from the other end of the resistor element, one of the second pair of electrode terminals being a current terminal, the other of the second pair of electrode terminals being a voltage terminal; at least one of the electrode terminals of the first and second pairs being formed with a trimmed portion extending along the resistor element at least at one end thereof; wherein the method comprising the steps of:

supplying a current across the current terminals of the first and second pairs; and measuring a voltage drop across the voltage terminals of the first and second pairs.

9. A method of adjusting a resistance of a chip resistor which comprises: an insulating chip substrate; a resistor element formed on the chip substrate; a first pair of electrode terminals branching out from one end of the resistor element, one of the first pair of electrode terminals being a current terminal, the other of the first pair of electrode terminals being a voltage terminal; and a second pair of electrode terminals branching out from the other end of the resistor element, one of the second pair of electrode terminals being a current terminal, the other of the second pair of electrode terminals being a voltage terminals; wherein the method comprising the steps of:

supplying a known current across the current terminals of the first and second pairs;

measuring a voltage drop across the voltage terminals of the first and second pairs; and trimming at least one of the electrode terminals of the first and second pairs along the resistor element at least at one end thereof until the measured voltage drop reaches a predetermined value.

* * * * *